US005469708A

United States Patent [19]

Harrison et al.

[11] Patent Number: 5,469,708

[45] Date of Patent: Nov. 28, 1995

[54] WATER COOLER

[76] Inventors: Howard R. Harrison, 1302 Martley Drive; Jeffrey R. Brown, 1309 Martley Drive, both of Mississauga, Ontario, Canada

[21] Appl. No.: 311,240

[22] Filed: Sep. 23, 1994

[51] Int. Cl.[6] ..... F25B 21/02

[52] U.S. Cl. ..... 62/3.64; 222/146.6

[58] Field of Search ..... 62/3.64, 394, 395; 222/146.6, 185

[56] References Cited

U.S. PATENT DOCUMENTS

| | | | |
|---|---|---|---|
| 3,243,965 | 4/1966 | Jepson | 62/395 X |
| 4,274,262 | 6/1981 | Reed et al. | 62/3.64 |
| 4,311,017 | 1/1982 | Reed et al. | 62/3.64 |
| 4,757,920 | 7/1988 | Harootian, Jr. et al. | 62/3.64 X |
| 4,804,118 | 2/1989 | Mullen et al. | 62/3.64 X |
| 4,913,713 | 4/1990 | Bender et al. | 62/395 X |
| 5,377,878 | 1/1995 | Rainey et al. | 222/185 X |

FOREIGN PATENT DOCUMENTS

| | | | |
|---|---|---|---|
| 1323450 | 2/1963 | France | 62/3.64 |

*Primary Examiner*—William E. Tapolcai
*Attorney, Agent, or Firm*—Jane Parsons

[57] ABSTRACT

A water cooler is disclosed suitable for standing on a counter top and to be used with standardized water bottles. The water cooler utilizes a thermoelectric device which cools by means of the Peltier effect. The cooling unit comprises a seat for the water bottle spaced and thermally insulated from a heat sink. The thermoelectric device is connected between the seat and a heat sink. Preferably the thermoelectric device is connected between a spacer block extending downwardly from the seat and the heat sink. A fan dissipates heat from the heat sink.

11 Claims, 5 Drawing Sheets

WATER COOLER

BACKGROUND OF THE INVENTION

1. Field of the Invention

This invention relates to cooling apparatus for use with commercially available water bottles, especially counter-top standing coolers for water bottles or for bottles for containing other liquids such as juice, containing a relatively small amount of water, e.g. about 10 liters 2. Acknowledgement of Prior Art Water coolers for domestic use have become relatively commonplace and frequently may be floor standing models which are adapted to receive a large cylindrical water bottle typically containing, say, 20 gallons of liquid. Such cylindrical water bottles must be lifted and positioned and tipped into a neck down position with the bottle top opened so that water may be drawn off from a spigot of the apparatus. Such water bottles are unwieldy and difficult to handle on a domestic basis. In fitting the bottle into place water is frequently spilt.

A number of counter-top standing water coolers have been suggested such as those disclosed in U.S. Pat. No. 4,866,945 issued Sep. 18, 1989 to Bender et al and in U.S. Pat. No. 4,913,713 issued Apr. 3, 1990 to Bender et al. Such counter-top coolers as disclosed by Bender comprise an insulated casing and a thermoelectric cooling element by means of the Peltier effect. A spigot of the water bottle itself is located to withdraw liquid from the container thus the spigot is located as low as possible with respect to the body of the container. A thermoelectric element is located to the rear of the container.

Numerous other cooling containers, cans, kegs, or other containers are exemplified by the disclosures of U.S. Pat. Nos.

| | | |
|---|---|---|
| 4,671,070 | June 9, 1987 | Rudick |
| 3,399,539 | Sept. 3, 1968 | Herman |
| 3,243,965 | April 5, 1966 | Jepson |
| 3,155,157 | Nov. 3, 1964 | Anderson et al |
| 3,178,896 | April 20, 1965 | Sandsto, and |

Canadian Patent No. 1,016,604 issued Aug. 30, 1977 to Unifridge Canada Ltd.

A number of problems have been experienced in thermoelectric device coolers. When they are to be used for water bottles, difficulty has been found in providing intimate contact of the cooling surface with a container wall to provide fast adequate cooling of liquid in the container in the immediate region of the spigot.

Adequate sealing of the thermoelectric device itself to protect it from condensation has also been a problem. It is theorized that it may be for this reason that it has not been practicable to attempt to cool a lower surface of the bottle because the thermoelectric device must be protected from moisture it has been desirable to locate it as high as possible.

The heat removed from the liquid in the water bottle is usually dissipated from a heat sink by means of a fan but high temperatures in the heat sink have tended to influence the temperature of liquid in the bottle and has counteracted the effects of cooling.

The present inventors have addressed the many problems involved with conventional counter-top coolers.

SUMMARY OF THE INVENTION

A cooler according to the invention comprises a water bottle having its own spigot which, in an in-use position, is located in a lower part of the container so that the bulk of liquid in it may be drawn off. The water bottle has a base adjacent to its spigot, the lower surface being seated on a cooling seat which is intimately shaped to conform with the shape of the base of the water bottle. This seat comprises a cooling surface which is cooled by thermoelectric cooling from a thermoelectric device.

It is to be noted that the base of the water bottle referred to, is the base of the bottle when located in/on the cooler. It is quite possible that another surface may constitute the bottom of the bottle for storage purposes.

Since the bottle has its base located on the seat and since the spigot is located in the lower part of the bottle, liquid immediately adjacent to the base. i.e. in a lower part of the bottle, will be cooled and drawn off from the spigot. When cooling is possible over a long period it is quite likely that the entire bulk of liquid in the bottle will be cooled but liquid in the region of the spigot is preferentially cooled. Moreover, when the bottle is not full, since the cooling seat is in contact with the base of the container, it will remain effective over its whole area.

Accordingly the invention provides a counter-top cooler for liquid containers having an operable outlet for liquid, the outlet being positioned such that, when the container is oriented for dispensing liquid with the outlet open, liquid in the container flows out to substantially empty the container, the cooler comprising:

a thermally conductive seat having an upper seat surface shaped for intimate contact with at least a substantial part of a lower base of the container oriented for dispensing liquids; thermoelectric cooling means connected to a lower surface of the seat to remove heat from the seat; a heat sink for dispersion of heat removed from the seat; insulating screen means to screen an under part of the seat from the heat sink; and a fan to disperse heat from the heat sink.

A water bottle of current conventional shape may have a generally rectangular cross section and an in-use base which, at least over a large portion of its area is also of generally rectangular shape. It is probable that the corners and edges of such a bottle are curved or bevelled so that the base surface may actually have a section of a shallow wide webbed U. In this case the cooling seat may be similarly shaped as a shallow U-shaped track open to the front. Thus, the cooling seat, may have shallow upstanding sides to conform to the base of the bottle. These shallow upstanding sides may act as guides for the bottle when it is placed in position on the seat by sliding from front to back.

While, for efficiency reasons, a heat insulated housing for the water bottle to cover its sides and top is normally considered an important part of the cooler, it is envisaged that due to the base cooling of liquid through the base in a lower region of the bottle, such an insulated housing may not be an absolute necessity. Moreover, loose insulation may be added as a slip on cover for the bottle or in other manners.

It is important to appreciate that in the specification and claims the term "base" of the bottle or container will be considered as the lower surface of the bottle or container when in use. This base may probably be a side surface of the container when it is stacked on supermarket shelves or otherwise stored. Thus for storage purposes it is desirable that the spigot is at the top of the container so that no accidental leakage is likely whereas, in use, the spigot should be set low in a side wall. Bottles of this type frequently provide a weakened point so that the user may provide a vent hole when the bottle is positioned.

BRIEF DESCRIPTION OF THE DRAWINGS

Embodiments of the invention will now be described by way of example with reference to the drawings, in which.

DETAILED DESCRIPTION OF A PREFERRED EMBODIMENT

Figure 1:
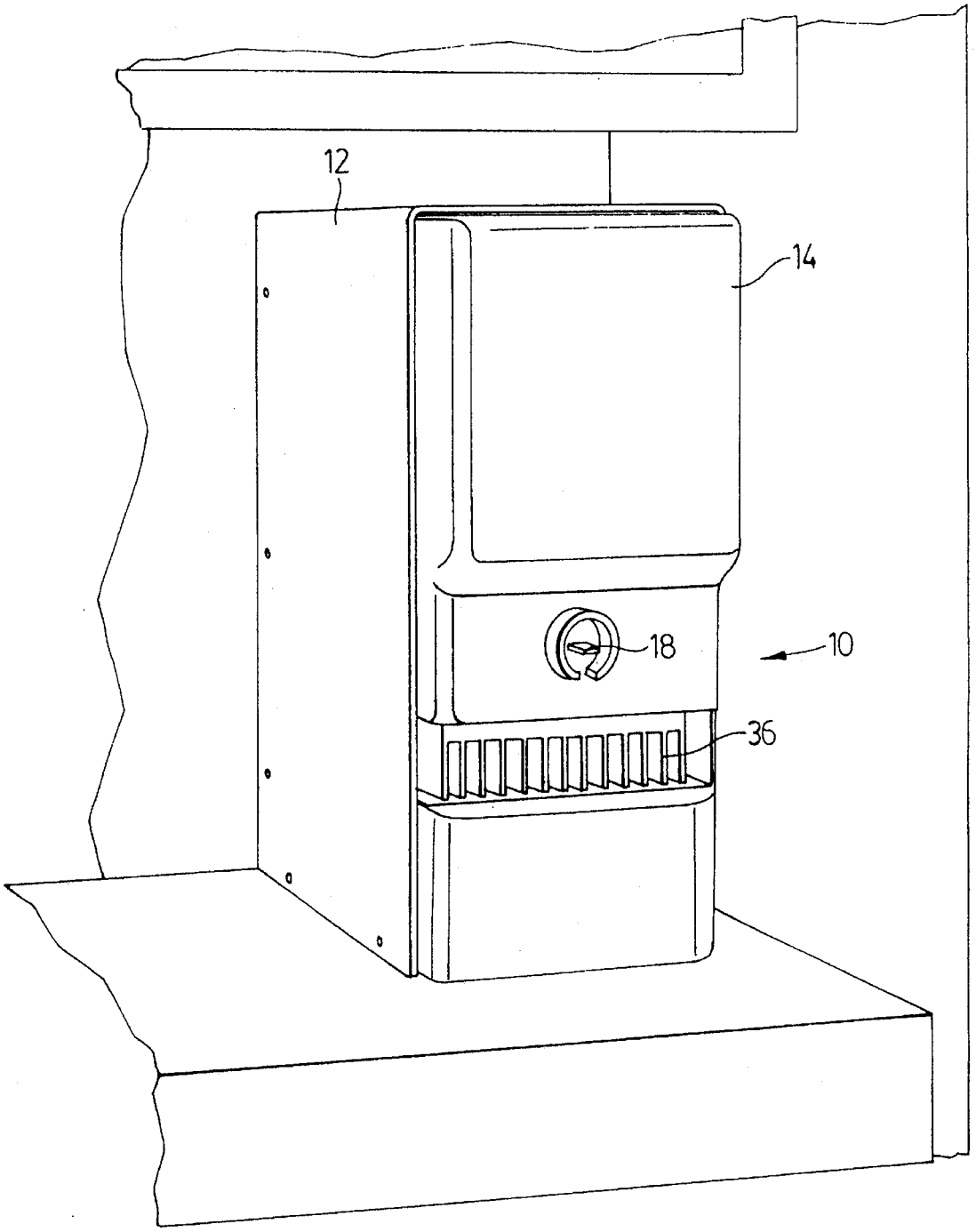
FIG. 1 is a perspective view of a cooler according to the invention located in place on a counter-top and having a housing for the water bottle.
Figure 2:
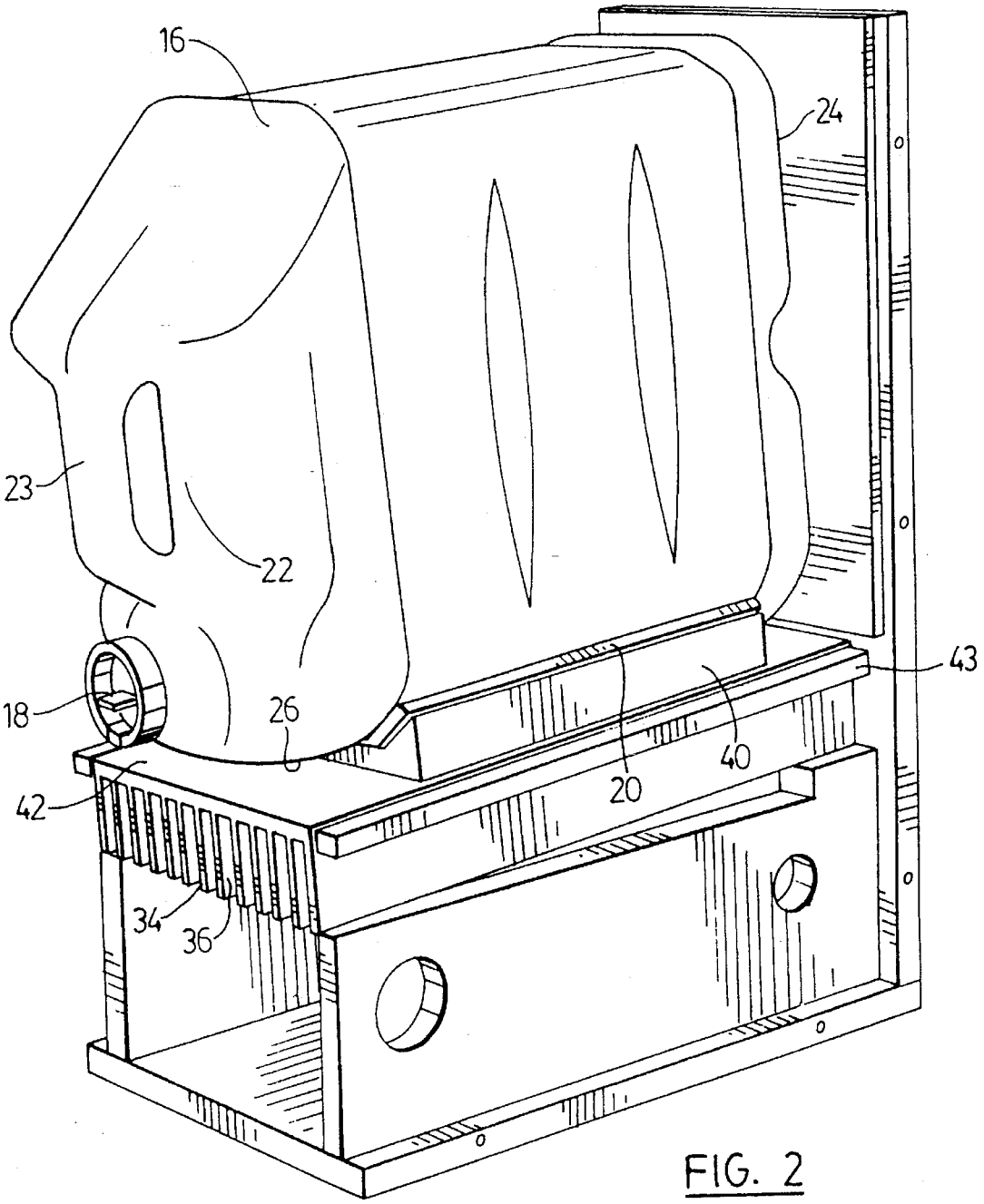
FIG. 2 is a perspective view of the cooler of FIG. 1 with the housing removed.
Figure 3:
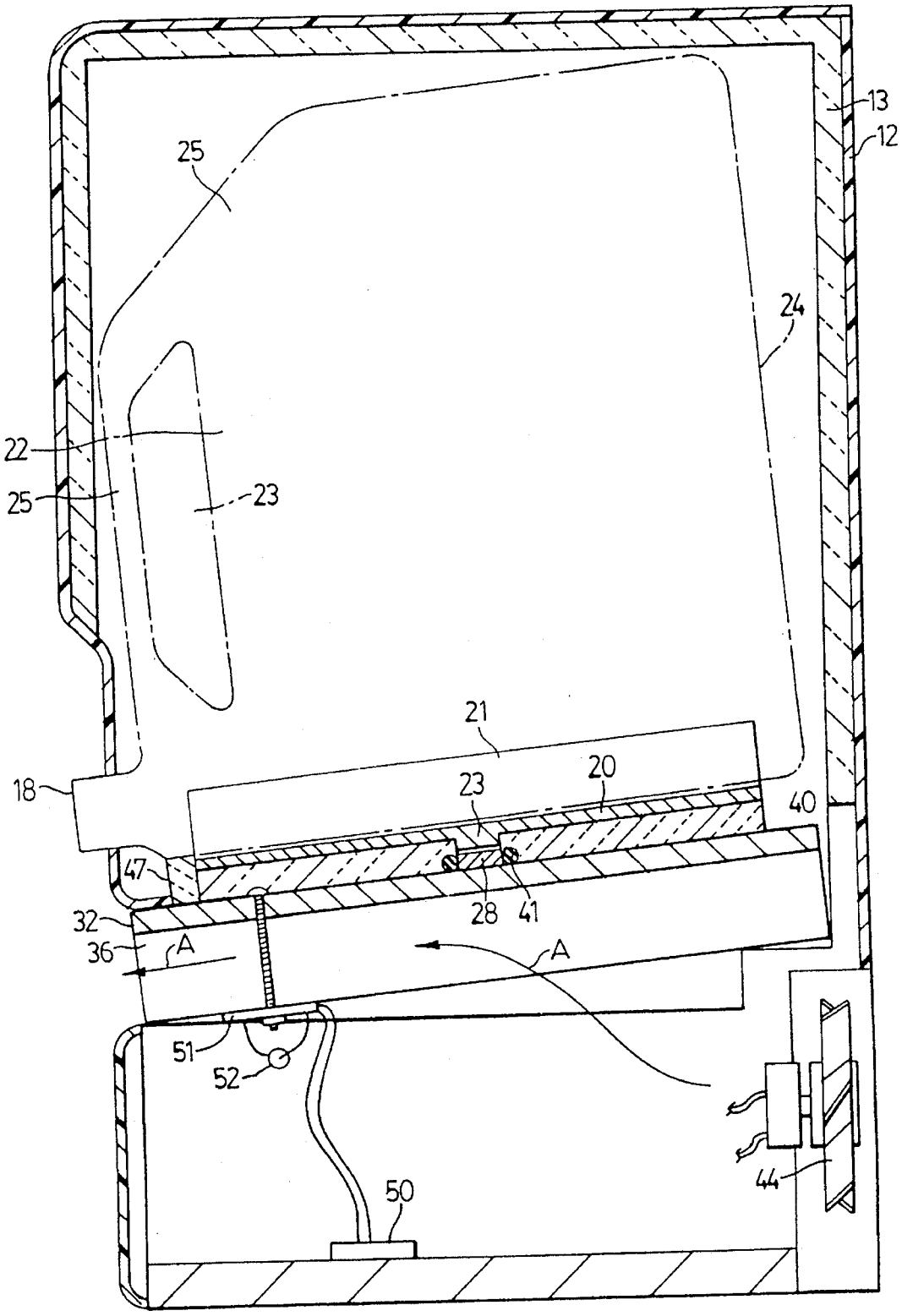
FIG. 3 is a vertical section from front to back of the cooler.
Figure 4:
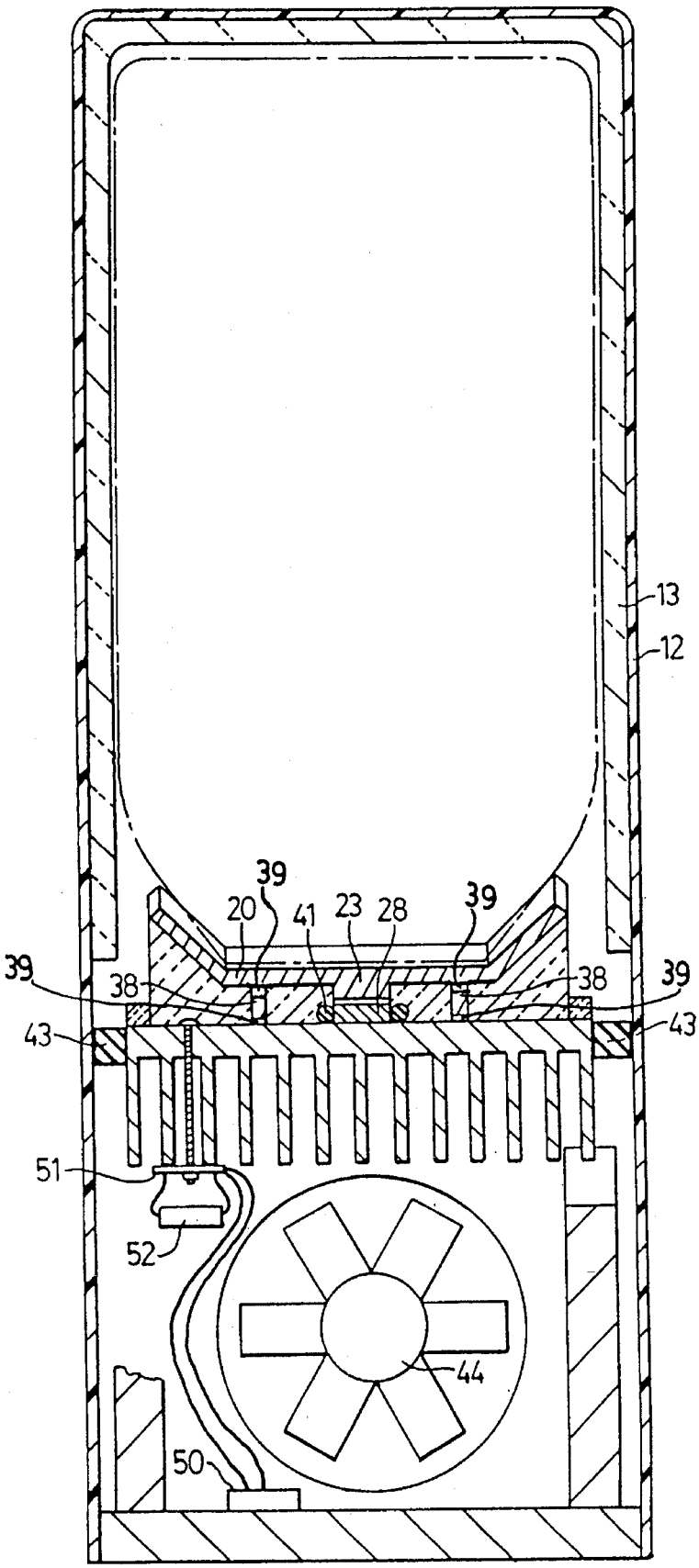
FIG. 4 is a vertical section from side to side of the cooler.
Figure 5:
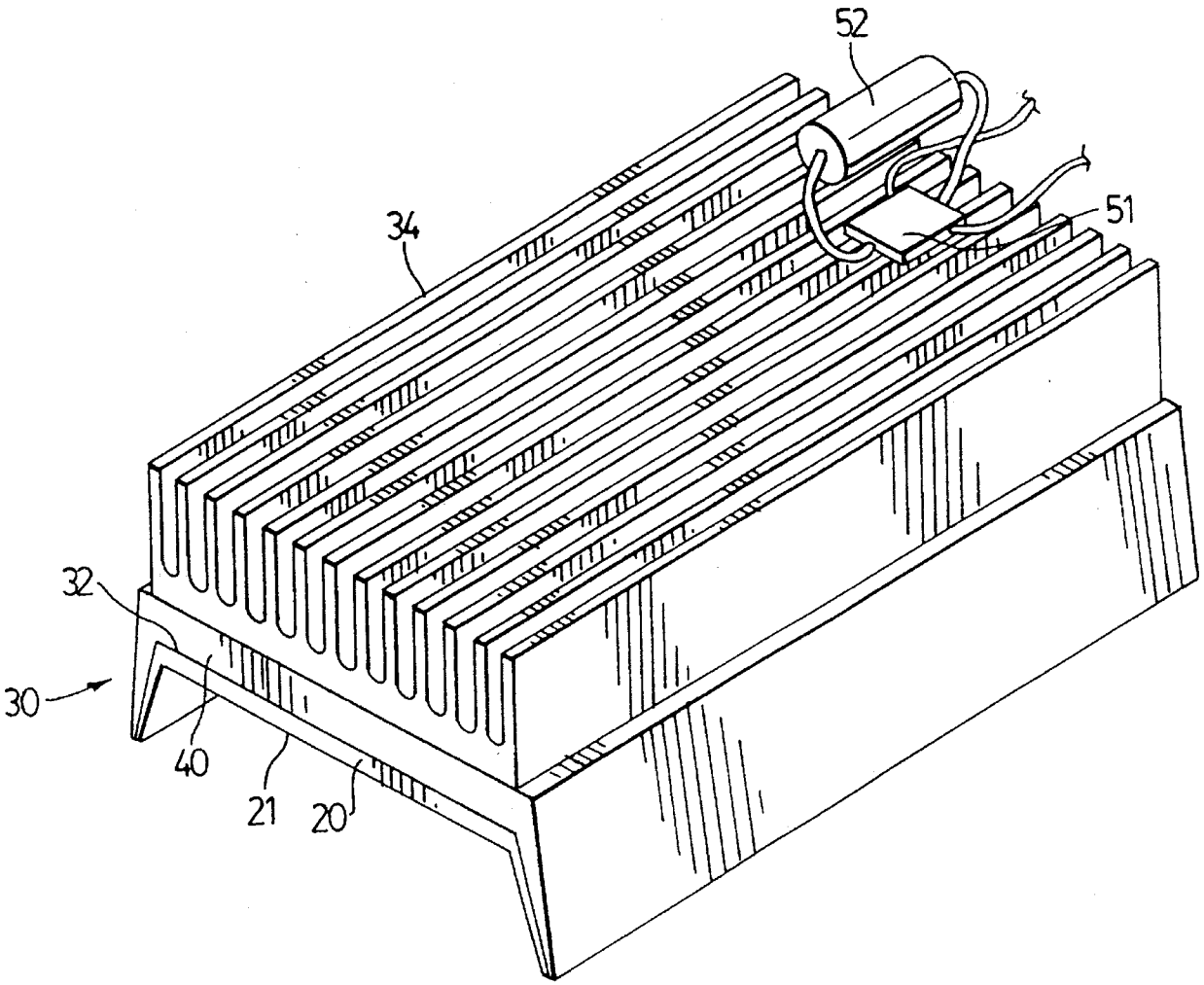
FIG. 5 is a perspective view of the cooling unit of a cooler of the invention.

A cooler 10 comprises a housing 12 having insulation 13 and a front opening door 14. The door 14 has an aperture through which the spigot 18 of a water container 16 projects. The door 14 may open by any convenient means for insertion of the water bottle 16 into housing 12. For example, the door 14 may be hinged to the housing 12 at either side or at the bottom or top of the door or it may merely slot into a front opening of the housing to frictionally fit therein, or it may be secured with magnetic catches.

The water container 16 may be inserted through the front opening door 14 to slide on a support 20 having a support surface 21 of the cooler 10. The container 16 may suitably be a container of generally rectangular cross-section having a spigot 18 located towards one end of a side surface 22.

In storage, or on supermarket shelves side surface 22 may be the top surface of the container which stands on its storage base surface 24. Thus surface 22 may have a handle 25 for carrying the container between storage locations. Handle 25 may be useful for sliding a full container into position into housing 12 or removing an empty container therefrom. In use, in the cooler 10, the bottle 16 is turned sideways so that a surface 26 (which in storage is a vertical side surface) becomes the use base surface. Surface 26 will be referred to as the base surface throughout this description since the present invention is concerned with the bottle when located in the cooler.

When located in the cooler, however, surface 22 is vertical with the spigot 18 at its lower end.

While a rectangular container 16 has been illustrated having bevelled or curved corners and having a spigot 18 located centrally towards one end of surface 22, it is perfectly possible to use bottles of other shapes. If the support surface 21 of the support 20 is shaped to fit closely against the base surface 26 of the container. When the base surface 26 of the container is, for example, an arcuate part of a cylindrical surface of a cylindrical container, the support surface 21 should be conformed to the shape of that bottle. Nevertheless, for domestic applications, water containers having a generally rectangular cross section and containing around 10 liters of liquid are standard.

The support 20 is formed of metal or other heat conducting material and support surface 21 is the top cooling surface of a cooling unit 30 in heat conductive relationship with the cold junction of thermoelectric device 28 to be cooled by it by the Peltier effect and, in turn, cool liquid in container 16.

The body of support 20 should be thermally insulated from the heat sink 32 except through the connector with thermoelectric device 28 which removes heat from support 20 and transfers it to heat sink 32. This may be achieved by spacing support 20 above heat sink 32 and filling the space with insulation 40. A spacer block 23 extends downwardly from support 20 through insulation 40 to thermally contact the thermoelectric device 28. Preferably the upper cold surface of the thermoelectric device 20 and the lower surface of the spacer block 23 are coextensive. The lower surface of the thermoelectric device 28 may be firmly adhered or otherwise attached to the upper surface of heat sink 32.

Preferably there is no other thermal contact between support 20 and heat sink 32. Thus heat removed from support 20 by the thermoelectric device is not easily retransmitted to it from heat sink 32 by conduction or by radiation.

The thermoelectric device 28 may be surrounded by a gasket 41 comprising closed cell foam adjacent to the device and surrounded by a waterproof sealant to protect the device from condensation, The closed cell foam may be, for example, polyurethane foam. The sealant may be a room temperature vulcanized sealant.

While it is possible to bolt the support 20 to the heat sink, such bolts would allow for some heat transmission between the heat sink 32 and the support 20. It has surprisingly been found that such bolts are not necessary and that adhesive alone may provide a suitable unit 30 provided that means are provided to counter any torque between support 20 and heat sink 32 which might tend to stress the adhesive bond. For this reason support posts 38 are provided to either side of spacer block 23. Support posts 38 are thermally insulated with thermal insulation 39 from both heat sink 32 and support 20 and are adhered to each of them. As illustrated two support posts 38 are provided but any suitable number may be used.

The cooling unit 30 is a sandwich essentially comprising the thermoelectric device 28 sandwiched between cooling support 20 on the one hand and heat sink 32 on the other hand. The lower hot surface of the thermoelectric device 28 itself may be adhered to a top surface of heat sink 32 and the upper cold surface may thermally contact support 20 while being electrically insulated from it. In fact, to allow for room for adequate insulation 40, the upper cold surface contacts the lower surface of spacer block 23.

Heat sink 32 comprises a plate of metal in heat conductive relationship with the heating side of thermoelectric device 28 and having fins 34 projecting from its lower surface to help dissipate the heat. Below the fins 34, a fan 44 is provided to draw the heat away from the heat sink. Conveniently the fins 34 run from front to back of the cooler forming a grating to the front. The fan 44 may be directed to drive hot air between the fins and out of the grating 36 in the direction of arrows A.

The thermoelectric device 28 may conveniently be any suitable module having sufficient cooling capacity to cool the contents of the liquid container to the desired temperature. Thus, when the container is a 10 liter water bottle and it is desired to cool the temperature of liquid to a comfortably cool temperature for drinking in domestic and office environments which are comfortable for living, the thermoelectric module may be that sold by Material Electronics Corporation as Melcor Cp 4-127-0456-1.

The support 20 is screened from the heat sink 32 by a layer of insulation 40. The whole unit 30 may be unitarily assembled by means of bolts bolting together the support surface 20, the insulation 40 and the heat sink 32. It is, however, possible to adhere the components together using adhesives especially if support posts 38 are incorporated between the heat sink 32 and the support surface 20 to strengthen it against shear and cantilever forces which might put undue stresses on adhesives at low temperatures.

The insulation 40 between the support surface 20 and the heat sink 32 is conveniently also closed cell foam such as polyurethane foam to provide good insulation between the cold surface and the heat sink.

An arrangement of providing a support 20 for the water container 16 which support surface 20 provides the cold surface for cooling the liquid may not have been considered possible in the past due to the potential accumulation of condensation. It is for this reason that especially efficient sealing means on the thermoelectric device 28 is considered suitable. However, it is possible to tilt surface 21 slightly, for example about 5 degrees so that any condensation will flow downwardly in the direction of the tilt. A reservoir 42 may be provided for this condensation. The reservoir may, of course, be any convenient vessel or container but, conveniently may be a piece of sponge in the path of heat directed out of grating 36 by fan 44. Additional pieces 43 of sponge may be provided along front to back edges of heat sink 32. Thus, condensation will be evaporated from the sponge 42 and removed from the environment of the cooler 10. Fan 44 may, of course, be any suitable type of fan but is conveniently is axial fan rather than a centrifugal fan to provide maximal direction of heat away from the cooler.

The thermoelectric device 28 may be connected for use with a standard 110 AC electrical supply through a transformer 50, rectifier 51, and condenser 52. Conveniently and practically, at least one of the rectifier 51 and transformer 50 may be located in the airflow from fan 44 which may help dissipate heat from them in addition to dissipating heat from heat sink 32. Transformer 50 may be located on the floor of the water cooler 10. The rectifier 51 is attached to the heat sink in thermally conducting relation therewith so that heat dissipated from the heat sink includes heat generated by the rectifier.

One or more blocks 23 may be provided each with its associated thermoelectric device 28. It is believed that provision of the cold surface at the bottom of the water container, the efficient removal of heat from the heat sink, the insulation between the cold support 20 and the heat sink 32 provide a degree of efficiency that only two thermal connections may be necessary for a warm container of, say, 10 liters. This, of course, is especially true when the water container is only partially filled. It is, of course, possible to remove the container from the water cooler before dispensing liquid therefrom.

We claim:

1. A counter-top cooler for liquid containers having an operable outlet for liquid, the outlet being positioned such that, when the container is oriented for dispensing liquid with the outlet open, liquid in the container flows out to substantially empty the container, the cooler comprising:

a thermally conductive support having an upper seat surface which is angled at a front edge about 5 degrees to the horizontal and shaped for intimate contact with at least a substantial part of a bottom surface of the container;

thermo electric cooling means connected to a lower surface of the seat to remove heat from the seat;

a heat sink for dispersion of heat removed from the seat;

insulating screen means to screen an underpart of the set for the heat sink;

a reservoir being located at the front edge of the thermally conductive seat for run off of condensation a fan located to direct air flow to evaporate liquid in said reservoir in the heat sink to disperse heat therefrom.

2. A cooler as claimed in claim 1 in which an insulated housing is provided for the liquid container.

3. A cooler as claimed in claim 1 in which the thermoelectric cooling means in a thermoelectric device sealed in an inner layer of closed cell foam and an outer layer of waterproof sealant.

4. A cooler as claimed in claim 1 in which the heat sink comprises a finned plate.

5. A cooler as claimed in claim 4 in which fins of the finned plate run from the front to rear of the cooler forming a grating to the front.

6. A cooler as claimed in claim 1 in which the reservoir is sponge.

7. A cooler as claimed in claim 1 in which an electric circuit for the thermoelectric cooling means included a transformer, a rectifier and a condenser.

8. A cooler as claimed in claim 7 in which at least one of the transformer and rectifier is located in the air flow from the fan for dissipation of heat therefrom.

9. A cooler as claimed in claim 1 in which the thermally conductive support is spaced from the heat sink by a layer of insulation, a cold surface of the thermoelectric cooling means is thermally connected to the support through a connecting spacer block extending through the insulation and a hot surface of the thermoelectric cooling means is adhered to a surface of the heat sink.

10. A cooler as claimed in claim 8 in which thermally insulated support posts are connected between the support and the heat sink.

11. A cooler as claimed in claim 7 in which the rectifier is attached to the heat sink for thermal conduction between the heat sink and the rectifier.

* * * * *